US007892045B2

(12) United States Patent
Ratzlaff et al.

(10) Patent No.: US 7,892,045 B2
(45) Date of Patent: Feb. 22, 2011

(54) CONNECTOR HAVING INTERLOCKING COMPONENTS

(75) Inventors: Thomas D. Ratzlaff, Menlo Park, CA (US); Inho Myong, Newark, CA (US); Rodney D. Boghosian, Atherton, CA (US)

(73) Assignee: Tyco Electronics Corporation, Berwyn, PA (US)

( * ) Notice: Subject to any disclaimer, the term of this patent is extended or adjusted under 35 U.S.C. 154(b) by 52 days.

(21) Appl. No.: 12/257,187

(22) Filed: Oct. 23, 2008

(65) Prior Publication Data

US 2010/0233899 A1 Sep. 16, 2010

(51) Int. Cl.
*H01R 13/502* (2006.01)

(52) U.S. Cl. ..... 439/701

(58) Field of Classification Search ..... 439/701, 439/108, 465, 470, 472
See application file for complete search history.

(56) References Cited

U.S. PATENT DOCUMENTS

| | | | | |
|---|---|---|---|---|
| 2,750,571 | A * | 6/1956 | Schmier | 439/472 |
| 3,671,921 | A | 6/1972 | Baker et al. | |
| 4,526,435 | A * | 7/1985 | Borne et al. | 439/470 |
| 4,657,331 | A * | 4/1987 | Coldren | 439/571 |
| 4,764,130 | A | 8/1988 | DiClemente | |
| 4,960,387 | A | 10/1990 | Davis et al. | |
| 4,986,769 | A | 1/1991 | Adams, III et al. | |
| 5,073,127 | A | 12/1991 | Daly et al. | |
| 5,244,415 | A | 9/1993 | Marsilio et al. | |
| 5,282,757 | A | 2/1994 | Maeda | |
| 5,431,577 | A | 7/1995 | Lincoln | |
| 5,480,329 | A | 1/1996 | Karlstroem et al. | |
| 5,613,881 | A | 3/1997 | Ichida et al. | |
| 5,890,931 | A | 4/1999 | Ittah et al. | |
| 6,247,978 | B1 | 6/2001 | Wu | |
| 6,354,878 | B1 | 3/2002 | Kropa et al. | |
| 6,416,346 | B1 | 7/2002 | Nakamura | |
| 6,478,631 | B1 | 11/2002 | Dutton et al. | |
| 6,524,135 | B1 | 2/2003 | Feldman et al. | |
| 6,840,789 | B2 | 1/2005 | Shibata | |

(Continued)

FOREIGN PATENT DOCUMENTS

DE 9312131 U1 2/1994

(Continued)

OTHER PUBLICATIONS

International Search Report for International Application No. PCT/US2009/005766, mailed Jan. 7, 2010.

(Continued)

*Primary Examiner*—Phuong K Dinh

(57) ABSTRACT

A connector that includes a main body having ends and sides with a passage extending between the ends. The passage is configured to receive at least one of conductors and cables and the main body includes a guide channel that extends from at least one end and a guide channel that extends from at least one side into the main body. The guide channels join each other at an intersection. The connector also includes a first accessory that has a projection inserted into one of the guide channels and a second accessory that has a projection inserted into another of the guide channels. The projections engage each other at the intersection to secure the first and second accessories to the main body. A connector having a clamp sub-assembly secured to one end is also provided.

10 Claims, 6 Drawing Sheets

U.S. PATENT DOCUMENTS

| | | | |
|---|---|---|---|
| D523,399 | S | 6/2006 | Sakamaki et al. |
| 7,059,892 | B1 | 6/2006 | Trout |
| 7,137,848 | B1 | 11/2006 | Trout et al. |
| 7,294,010 | B1 | 11/2007 | Shaikh |
| 7,300,317 | B2 | 11/2007 | Dillon et al. |
| 7,303,438 | B2 | 12/2007 | Dawiedczyk et al. |
| 7,318,757 | B1 | 1/2008 | Minich |
| 2001/0016457 | A1 | 8/2001 | Taguchi et al. |
| 2005/0118883 | A1 | 6/2005 | Kim |

FOREIGN PATENT DOCUMENTS

| | | | |
|---|---|---|---|
| DE | 19813458 | A1 | 10/1998 |
| EP | 1049214 | A1 | 11/2000 |
| GB | 2133638 | A | 7/1984 |
| GB | 2134724 | A | 8/1984 |
| GB | 2384630 | A | 7/2003 |
| WO | WO-87/07088 | A1 | 11/1987 |
| WO | WO-99/62145 | A1 | 12/1999 |
| WO | WO-2008/091253 | A1 | 7/2008 |

OTHER PUBLICATIONS

International Search Report for International Application No. PCT/US2009/005755, mailed Dec. 30, 2009.
International Search Report for International Application No. PCT/US2009/005736, mailed Mar. 18, 2010.
International Search Report for International Application No. PCT/US2009/005735, mailed Jan. 25, 2010.

* cited by examiner

CONNECTOR HAVING INTERLOCKING COMPONENTS

CROSS-REFERENCES TO RELATED APPLICATION

The present application includes subject matter related to subject matter disclosed in U.S. patent application Ser. Nos. 12/257,107, 12/257,132, and 12/257,166 (now U.S. Pat. No. 7,544,084, issued Jun. 9, 2009), which were filed contemporaneously with this application, which are all incorporated by reference in their entirety.

BACKGROUND OF THE INVENTION

The subject matter herein relates generally to connectors, and more particularly, to connectors constructed from multiple interlocking components.

Connectors provide interconnects between components where power and/or signals may be transmitted therebetween. For example, connectors may be used within aircraft harnesses, avionics boxes, telecommunication equipment, servers, and data storage or transport devices. Typically, a connector may have several optional components that are coupled to one another in a variety of ways. For example, two components, such as a pair of housing shells, may be coupled to one another using a threaded fastener (e.g., screw), a spring where the components are coupled to each end of the spring, and retention pins. However, using additional hardware on these components may require extra steps in assembling the connector, may add costs to the raw materials, and may add unnecessary weight to the assembled connector.

Furthermore, components may be coupled to one another using a snap-fit (i.e., interference fit). For example, flexible latches may project from one component and grip another. However, the coupling between the two components may be exposed to the surrounding environment and may be easily disengaged, particularly where the connector is handheld and frequently inserted or removed by a technician.

Accordingly, there is a need for a connector where the components of the connector are coupled together using fewer pieces of hardware than known connectors. Furthermore, there is a need for connectors where the components do not inadvertently disengage. There is also a need for alternative mechanisms and methods for coupling components of a connector together.

BRIEF DESCRIPTION OF THE INVENTION

In one embodiment, a connector that includes a main body having ends and sides with a passage extending between the ends is provided. The passage is configured to receive interconnects for conveying at least one of signals and power, and the main body includes a guide channel that extends from at least one end and a guide channel that extends from at least one side into the main body. The guide channels join each other at an intersection. The connector also includes a first accessory that has a projection inserted into one of the guide channels and a second accessory that has a projection inserted into another of the guide channels. The projections engage each other at the intersection to secure the first and second accessories to the main body.

Optionally, the first and second accessories constitute at least one of conductor/cable strain relief, electrical shielding, electrical grounding, and environmental protection. Also, the guide channels may include first and second pairs where the guide channels in the first pair intersect the corresponding guide channel in the second pair. The guide channels may intersect each other at a substantially perpendicular angle and may be physically separate from the passage. Also, the first accessory may be held in a locked position adjacent to one of the sides, and the second accessory may be held directly against one of the ends in a locked position. Furthermore, one of the projections may include an aperture and the other projection may have a fitted end that is inserted into the aperture.

In another embodiment, a connector is provided that includes a main body that has front and back ends and a passage extending therebetween. The passage includes a passage opening at the back end that is configured to receive at least one of conductors and cables for conveying at least one of signals and power. The main body includes a guide channel that extends into the main body from the back end. The connector also includes a clamp sub-assembly that is secured to the back end and includes base and latch members that extend across the passage opening. The base member includes a projection that is inserted into the guide channel, and the latch member includes an arm configured to couple to the back end. The base and latch members couple to each other and form an interface therebetween when the arm of the latch member is coupled to the back end. The at least one of conductors and cables extend into the passage through the interface.

Optionally, the guide channel may extend along the passage within the main body and may be physically separate from the passage. The clamp sub-assembly may be held directly against the front end. Furthermore, the guide channel may include a pair of guide channels that extend into the main body and the projection may include a pair of projections that are inserted into the guide channels. In addition, the base member may include a slot where the arm is inserted into and couples with the slot when the arm couples to the back end.

DETAILED DESCRIPTION OF THE INVENTION

Figure 1:
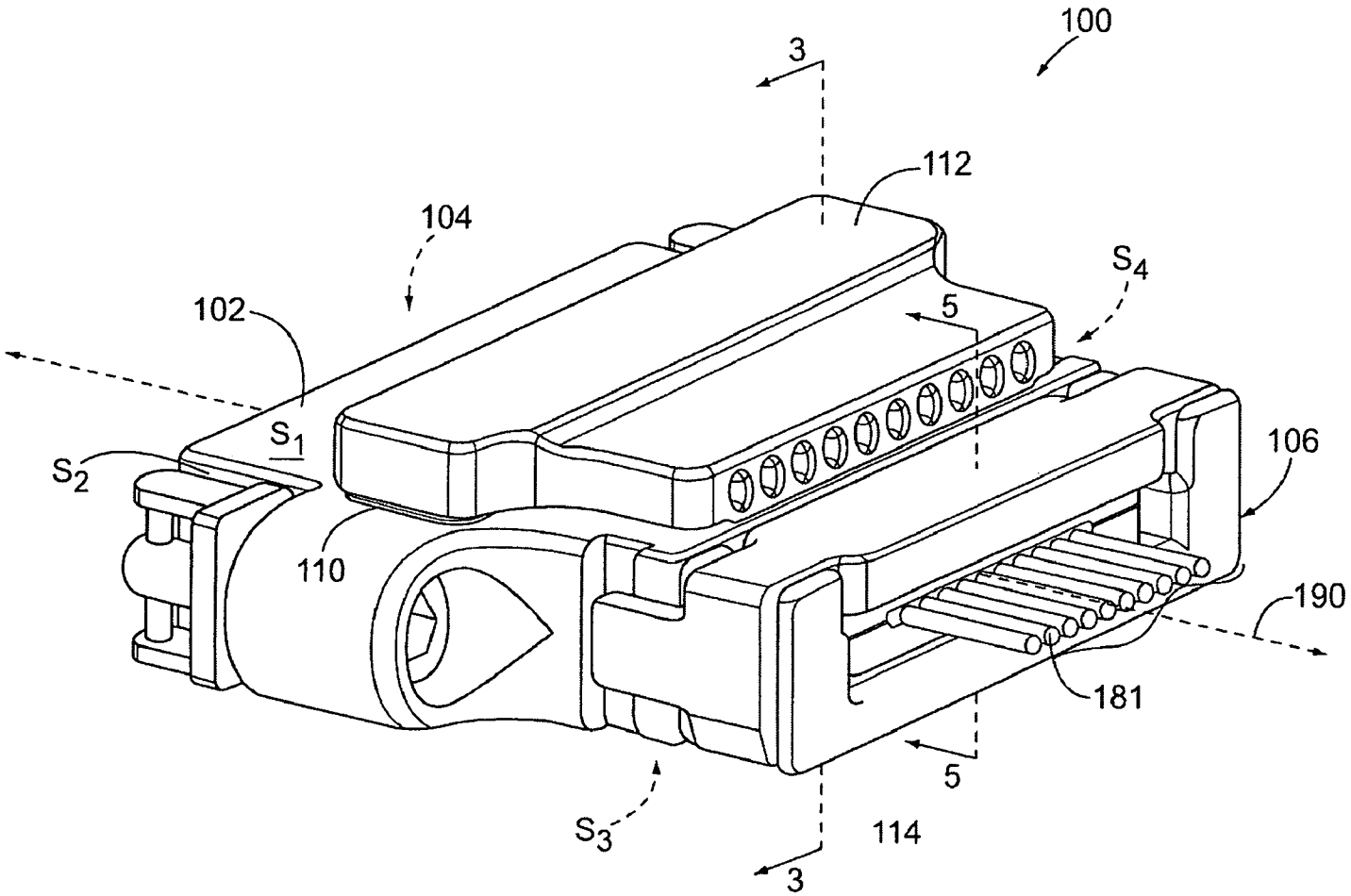
FIG. 1 is a perspective view of a connector formed in accordance with one embodiment.

FIG. 1 is a rear perspective view of a connector 100 formed in accordance with one embodiment. The connector 100 includes a main shell or body 102 having a front end 104, a back end 106, and a passage 108 (shown in FIG. 2) that extends therebetween along a central axis 190. The passage 108 is configured to hold conductors and/or cables 181 for conveying at least one of signal and power through the connector 100. As shown, the main body 102 has a plurality of outer sides $S_1$-$S_4$ that arranged about the central axis 190. The connector 100 also includes a plurality of components that are coupled to the main body 102. For example, the connector 100 may include an accessory, such as a grounding block accessory 112, attached to the side $S_1$ or $S_3$ of the main body 102, a busbar 110 positioned between the block accessory 112 and the main body 102, and a clamp sub-assembly 114 coupled to the back end 106 of the main body 102. However, the connector 100 may be coupled to a variety of components. As such, the following description of the components and locking mechanisms are provided for illustrative purposes only, rather than limitation, and the illustrated embodiment is but one application that may be used with the features and mechanisms described herein.

The connector 100 may be constructed from a pair of shells and held together as described in U.S. patent application Ser. No. 12/257,166 (now U.S. Pat. No. 7,544,084, issued Jun. 9, 2009), which is incorporated by reference in its entirety. Also, the connector 100 may be configured to prevent damaging the contacts when the connector 100 is mated with a complementary connector, such as the plug and receptacle connectors described in U.S. patent application Ser. No. 12/257,107, which is incorporated by reference in its entirety. Also, the connector 100 may be configured to hold one or more contact modules therein as described in U.S. patent application Ser. No. 12/257,132, which is incorporated by reference in its entirety.

Figure 2:
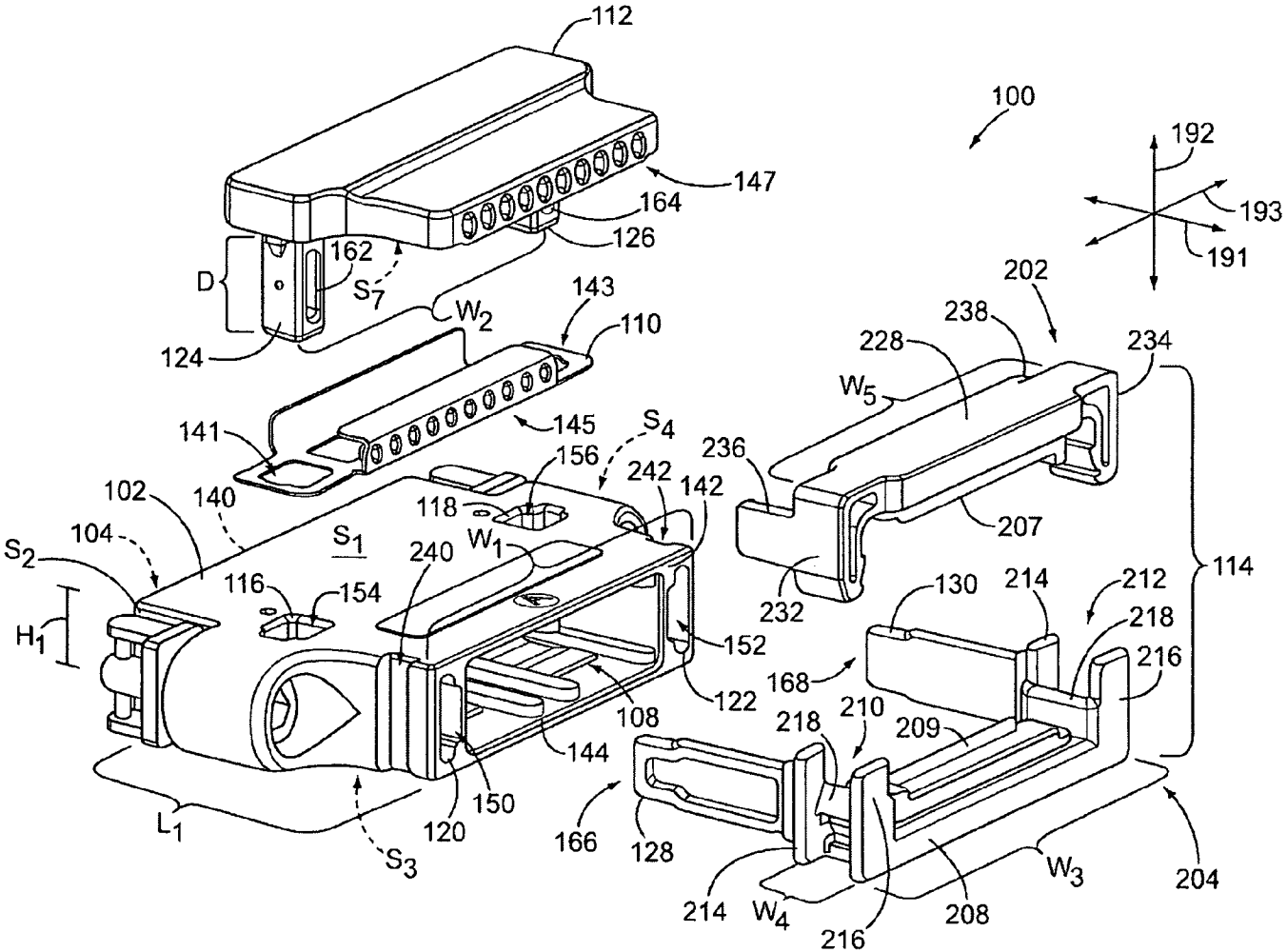
FIG. 2 is an exploded view of the connector shown in FIG. 1.

FIG. 2 is an exploded view of the connector 100 and illustrates the components in greater detail. As will be discussed further below, the connector 100 may include one or more coupling or locking mechanisms for interlocking the main body 102 and other components together into a unitary structure. For example, the main body 102 may include two pairs of guide channels 116, 118 and 120, 122 that extend from openings into the main body 102. The block accessory 112 may be made from a composite material that includes a pair of projections 124 and 126, and the clamp sub-assembly 114 may also include a pair of projections 128 and 130. The guide channels 116 and 118 are sized and shaped to receive the projections 124 and 126, respectively, and the guide channels 120 and 122 are sized and shape to receive the projections 128 and 130, respectively. The projections 124 and 128 and the projections 126 and 130 are configured to engage or couple to each other within the main body 102 such that the block accessory 112 is mounted to the main body 102 in a locked position. When the clamp sub-assembly 114 is coupled to the back end 106 of the main body 102, the block accessory 112 will remain in the locked position until the clamp sub-assembly 114 is disengaged from the main body 102. As such, the components of the connector 100 may be interlocked with each other within the main body 102.

Embodiments described herein may be electrical connectors, connectors that interconnect optical fibers, or optoelectronic connectors. As such, the phrase "conductors and/or cables" or the phrase "at least one of conductors and cables" includes electrical wires, conductors, or cables that transmit electrical signals or power or electrical signals and power, as well as optical fibers or cables used for transmitting signals in fiber-optic communication.

As used herein, the term "unitary structure," means that each component is directly coupled to at least one other component in such a way that the multiple components operate as a single unit. For example, in some embodiments, the connector may be handheld and inserted into or removed from a mated position by an operator's hand or tool. As used herein, the term "interlocked", when used with reference to two parts or components that are directly engaged or coupled to each other, means that the two components are coupled in such a way that the motion or movement of one component is restricted by the other coupled component. As such, interlocked components may allow some movement, but the range of movement is in some way limited by the other component. However, in other embodiments, when the connector is fully constructed the components of the connector are affixed in stationary positions as if the connector was integrally formed. The components would not be able to move unless disengaged from the other component(s).

Additionally, in some embodiments, the components may be coupled to each other without using fasteners. As used herein, a "fastener" means a separate part or piece of hardware whose sole or primary purpose is to couple separate components (or separate features of one component) to each other. For example, a fastener may be a screw, compressible pin, or separate latches configured, to grip and hold the components together. However, some of the components described above, such as the clamp sub-assembly 114, may have integrally formed features, such as a latch, projection, or flexible member, which are used to couple the components together. Such components are not "fasteners" because the components provide additional functions.

Furthermore, in some embodiments, one of the components is a primary or main component, such as the main body 102, and the other components are accessories. As will be shown below, the main component includes guide channels that are configured to intersect each other and receive projections from other components. In some embodiments, the main component may also provide a pathway through which electrical signals and/or power may be conveyed. As used herein, an "accessory" includes a component of the connector that is secondary or subordinate to the primary component. The accessories may be designed or configured for one or more functions including, but not limited to, conductor/cable strain relief, electrical shielding, electrical grounding, and/or environmental protection. For example, the busbar 110, the block accessory 112, and the clamp sub-assembly 114 described above are accessories to the main body 102. Also, the accessories and/or main components may be constructed from similar or different materials such as, but not limited to, metals and composite polymers.

Returning to FIG. 2, the main body 102 may be a plug or receptacle that is configured to mate with another connector. As shown, the main body 102 may be substantially rectangular and have a width $W_1$ that extends between sides $S_2$ and $S_4$, a length $L_1$ that extends along a longitudinal axis 191 (which, in the illustrated embodiment, is parallel to the central axis 190 (FIG. 1)) between a front end surface 140 and a back end surface 142, and a height $H_1$ that extends between the top side $S_1$ and the bottom side $S_3$.

In the illustrated embodiment, the top side $S_1$ may be substantially planar and extend in a longitudinal direction (i.e., a direction that is parallel to the longitudinal axis 191.) The side $S_1$ defines channel openings 154 and 156 that provide access to the guide channels 116 and 118, respectively. The channel openings 154 and 156 and corresponding guide channels 116 and 118 may be grooved or keyed to mate with the corresponding projections 124 and 126, respectively, when the projections 124 and 126 are inserted into the main body 102. In the illustrated embodiment, the guide channels 116 and 118 extend downward from the side $S_1$ in a substantially vertical direction (i.e., in a direction that is parallel to a vertical axis 192). The guide channels 116 and 118 may extend through the body 102 to intersect side $S_3$ or may terminate prior to side $S_3$.

The front and back end surfaces 140 and 142 are substantially perpendicular to the sides $S_1$ and $S_3$ and extend in the vertical direction. The front end surface 140 and the back end surface 142 may define a plurality of openings. More specifically, the back end surface 142 defines a back passage opening 144 to the passage 108 and the front end surface 140 defines a front passage opening 146 (shown in FIG. 3) to the passage 108. Furthermore, the back end surface 142 also defines channel openings 150 and 152 that provide access to the guide channels 120 and 122, respectively. The guide channels 120 and 122 extend from the back end surface 142 in the longitudinal direction. The channel openings 150 and 152 and corresponding guide channels 120 and 122 may be grooved or keyed to mate with the corresponding projections 128 and 130, respectively, of the clamp sub-assembly 114 when the projections 128 and 130 are inserted into the main body 102. Also shown, the main body 102 may have grooves 240 and 242 that extend vertically along the sides $S_2$ and $S_4$, respectively, and proximate to the back end 106.

Also shown in FIG. 2, the block accessory 112 has a substantially planar bottom surface $S_7$ configured to engage the busbar 110 and/or portions of the side $S_1$. The busbar 110 may be a stamped metal sheet that includes openings 141 and 143. The openings 141 and 143 are configured to have the projections 124 and 126 inserted therethrough. When fully assembled, the block accessory 112 rests on top of the busbar 110. Both the block accessory 112 and the busbar 110 operate together to provide a grounding path for the connector 100. For example, the busbar 110 may have a plurality of holes 145 that are aligned with holes 147 in the block accessory 112. The holes 145 and 147 may be configured to receive receptacles (not shown) inserted therethrough, which, in turn, are configured to receive pin contacts (not shown).

The projections 124 and 126 of the block accessory 112 extend a depth D and have a substantially rectangular shape. Also, the projections 124 and 126 are separated from each other by a width $W_2$ that, in one embodiment, is substantially equal to the $W_1$. Each projection 124 and 126 includes an aperture 162 and 164, respectively, that is configured to engage or mate with a corresponding fitted end 166 and 168 of the projections 128 and 130, respectively. In the illustrated embodiment, the apertures 162 and 164 extend in a longitudinal direction entirely through a thickness of the corresponding projections 124 and 126, respectively. In embodiments where guide channels 116 and 118 extend entirely through the body 102, accessories may be mounted from either side $S_1$ or side $S_3$.

Figure 3:
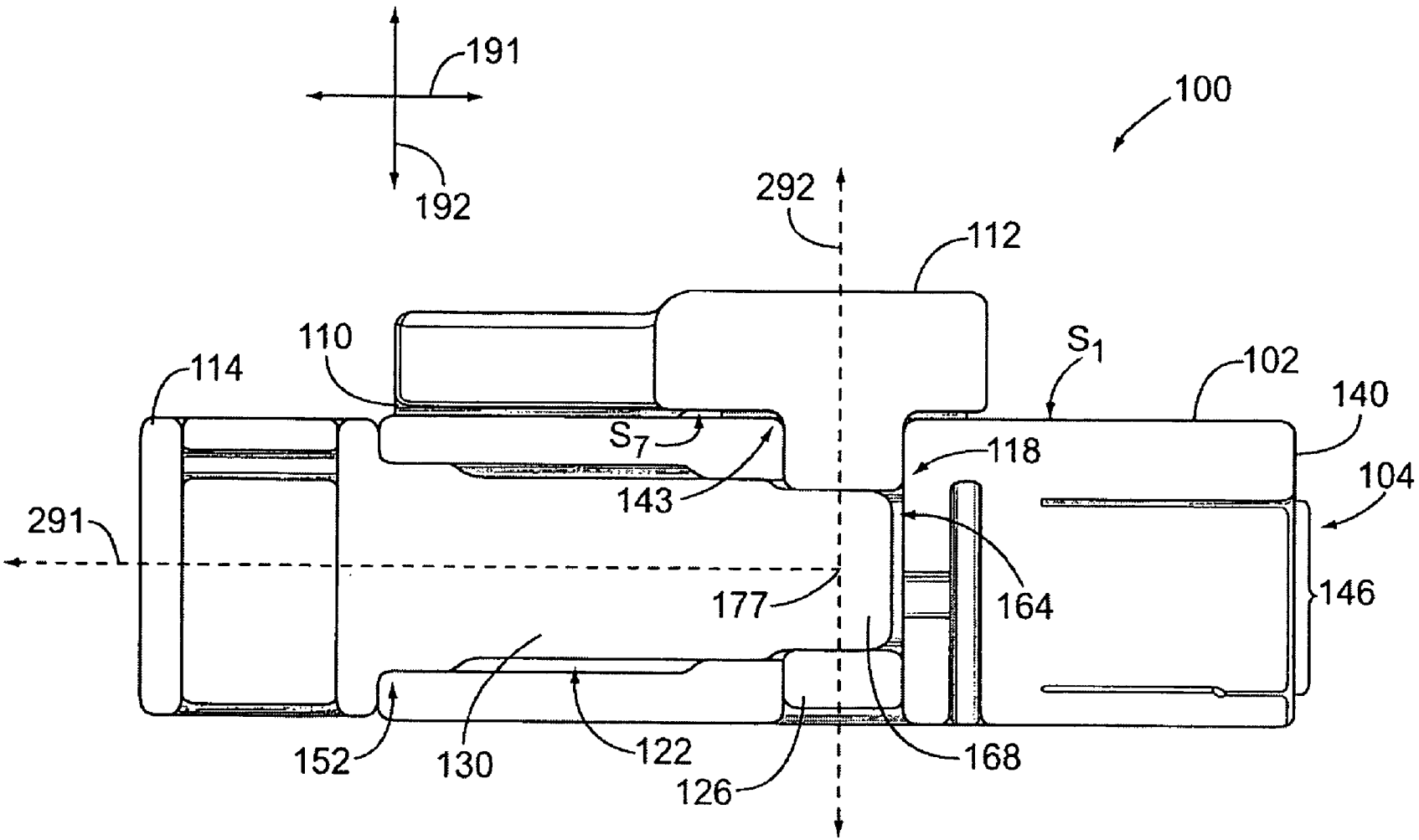
FIG. 3 is a cross-sectional side view of the connector taken along the line 3-3 shown in FIG. 1.

FIG. 3 illustrates a cross-sectional side view of the connector 100 taken along the line 3-3 shown in FIG. 1. (For illustrative purposes, the conductors and/or cables 181 are not shown in FIGS. 3-5.) Although the following is with specific reference to a cross-section proximate side $S_4$ (FIG. 1) of the connector 100, the description may similarly be applied to the other side $S_2$. As shown, the guide channel 118 extends along a guide axis 292, which in the illustrated embodiment is parallel to the vertical axis 192, and the guide channel 122 extends along a guide axis 291, which is parallel to the longitudinal axis 191. The guide axes 292 and 291 and corresponding guide channels 118 and 122, respectively, cross or join each other at an intersection 177. In the illustrated embodiment, the guide channels 118 and 122 extend entirely from the corresponding outer surface until the intersection 177 and are physically separate from the passage 108. However, in alternative embodiments, the guide channels may extend only a portion of the way in order to direct the corresponding projections and may extend within the passage 108. For example, the projections 126 and 130 may slide along inner surfaces (not shown) of the passage 108. In such an embodiment, the projections 126 and 130 may intersect and join each other at an intersection within the passage 108.

When the connector 100 is fully constructed, the projection 126 of the block accessory 112 is first inserted through the opening 143 of the busbar 110 and into the channel opening 156 of the main body 102 such that the busbar 110 is sandwiched between the block accessory 112 and the side $S_1$ of the main body 102. When the projection 126 is within the guide channel 118, the projection 126 is movable along the guide axis 292. The clamp sub-assembly 114 may then be inserted into the main body 102 such that the projection 130 is inserted through the channel opening 152 and into the guide channel 122. The aperture 164 of the projection 126 is positioned within the guide channel 118 such that the fitted end 168 of the projection 130 intersects or engages the aperture 164. When the fitted end 168 is engaged with the aperture 164, the projection 130 prevents the projection 126 (and, consequently, the block accessory 112) from moving along the guide axis 292.

As shown in FIG. 3, the block accessory 112 is in a locked position. More specifically, the surface $S_7$ is directly adjacent to and/or abutting the busbar 110 and the side $S_1$ of the main body 102. The guide channel 118 completely surrounds the projection 126 and prevents the block accessory 112 from moving in a lateral direction (i.e., parallel to an axis 193 (FIG. 2)) or in a longitudinal direction, and the projection 130 prevents the block accessory 112 from moving along the guide axis 292. As such, the projections 126 and 130 interact with each other and the main body 102 to provide a slide-in-bayonet coupling or locking mechanism for mounting the block accessory 112 to the main body 102.

In alternative embodiments, the guide axes 292 and 291 are not parallel to the axes 192 and 191, respectively. Furthermore, the guide axes 292 and 291 may intersect each other at a non-orthogonal angle (i.e., not perpendicular). In such embodiments, the aperture 164 may be configured to receive the fitted end 168 at a non-orthogonal angle. Also, although the axes 291 and 292 are linear, the guide channel 118 may extend along a path that is not linear (i.e., bends or curves). In these embodiments, the corresponding projection may either be conformed to the non-linear path or may be made from a flexible material allowing the projection to conform to the path when inserted into the guide channel.

In FIG. 3, the slide-in-bayonet locking mechanism only affects the movement of the block accessory 112. If the clamp sub-assembly 114 is not coupled to the main body 102 or held in a locked position, the projection 130 of the clamp sub-assembly 114 may inadvertently slide out of the guide channel 122 thereby disengaging the block accessory 112. As such, embodiments herein may hold the clamp sub-assembly 114 in a fixed or locked position against the back end 106.

Returning to FIG. 2, the clamp sub-assembly 114 includes an upper latch member 202 and a lower base member 204 that are configured to engage and interlock with each other. The base member 204 includes a crossbeam 208 having two ends that extend a width $W_3$. The width $W_3$ may be substantially equal to the width $W_1$ of the main body 102. A compressive grip 209 may extend alongside the crossbeam 208. Furthermore, the base member 204 also includes two slots 210 and 212 formed at ends of the crossbeam 208. Each slot 210 and 212 is formed by opposing sidewalls 214 and 216 and a grip member 218 that extends a width $W_4$ therebetween. Also shown, the projections 128 and 130 extend in a common direction from the sidewall 214 of the corresponding slot in a rear-to-front direction along the longitudinal axis 191.

The latch member 202 includes a crossbeam 228 having two ends that extend a width $W_5$ therebetween. The width $W_5$ may be substantially equal to the width $W_3$. The crossbeam 228 includes a pair of opposing arms 232 and 234 that project downwardly along the vertical axis 192. The opposing arms 232 and 234 are configured to slide within the slots 210 and 212, respectively. A compressive grip 207 may extend alongside the crossbeam 228. Also shown, the arms 232 and 234 include fingers 236 and 238, respectively, that project from the corresponding arm in a rear-to-front direction. The fingers 236 and 238 are configured to engage the back end 106 of the main body 102. For example, the fingers 236 and 238 may include outwardly projecting ridges 237 and 239 (shown in FIG. 5), respectively, that engage the grooves 240 and 242 of the main body 102. As shown, the fingers 236 and 238 are substantially rigid and inflexible. However, the fingers 236 and 238 may be configured to flex in alternative embodiments.

Figure 4:
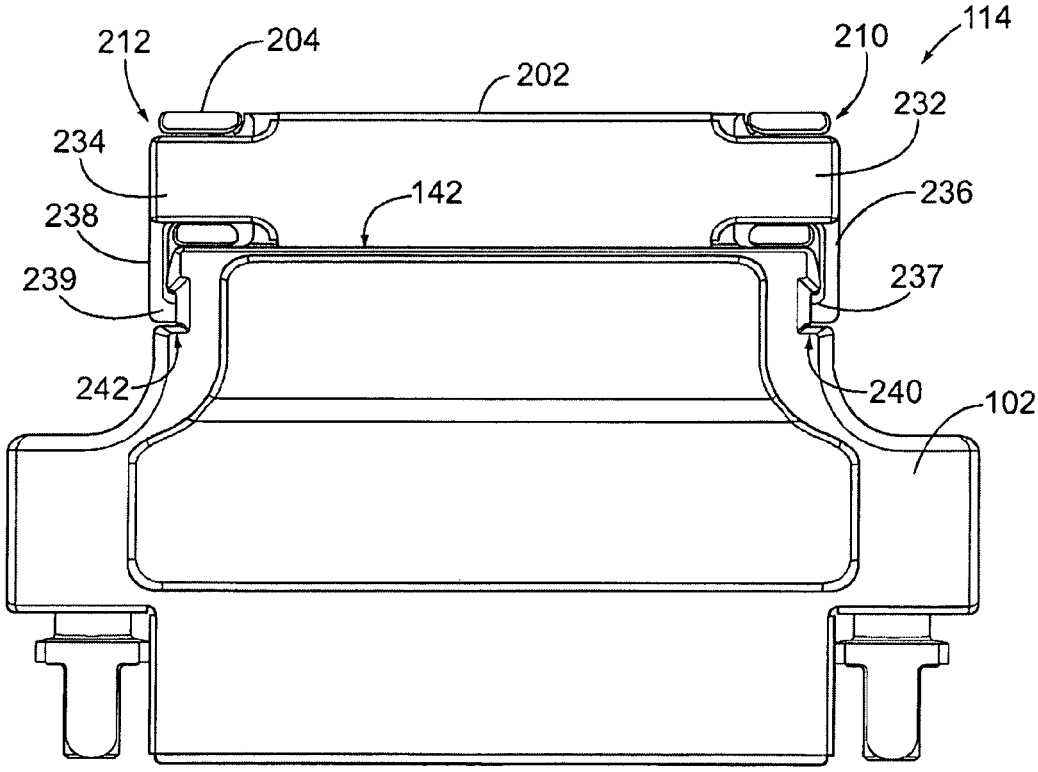
FIG. 4 is a top planar view of the connector shown in FIG. 1.
Figure 5:
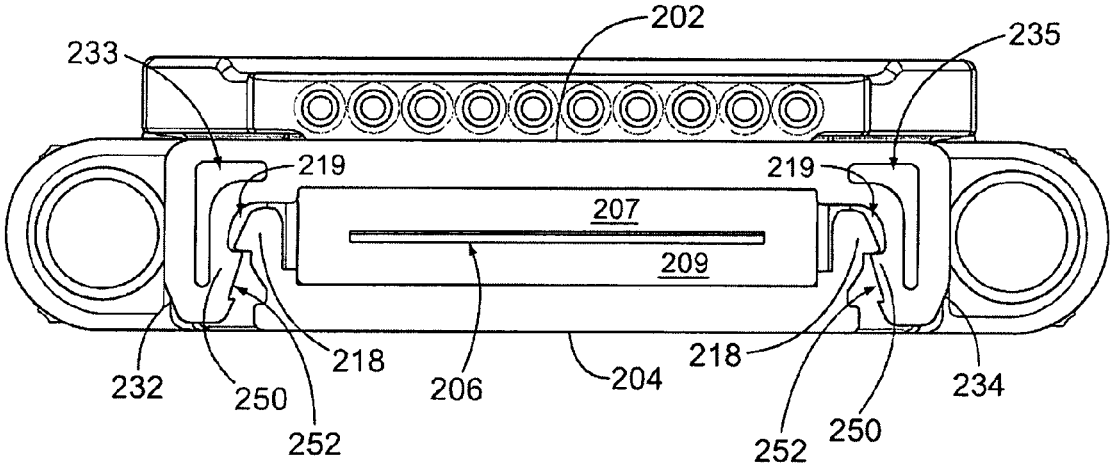
FIG. 5 is a back cross-sectional view of the connector taken along the line 5-5 shown in FIG. 1.

FIGS. 4 and 5 illustrate the clamp sub-assembly 114 in a fully engaged arrangement and coupled to the main body 102. FIG. 4 is a top planar view of the connector 100, and FIG. 5 is a cross-sectional view of the connector 100 taken along the line 5-5 shown in FIG. 1. As discussed above in FIG. 3, the projections 128 and 130 of the base member 204 are first inserted into the guide channels 120 and 122 of the main body 102. As shown in FIG. 4, when the base member 204 is fully inserted such that the base member is directly against the end surface 142, the latch member 202 may be lowered and engaged to the base member 204 and the main body 102. More specifically, the arms 232 and 234 are vertically aligned with the slots 210 and 212, respectively, and the ridges 237 and 239 are aligned with the grooves 240 and 242, respectively. The latch member 202 may then be lowered onto the base member 204 such that the ridges 237 and 239 slidably engage the grooves 240 and 242, respectively.

As the arms 232 and 234 move within the slots 210 and 212, respectively, the arms 232 and 234 may engage the grip members 218 such that the latch and base members 202 and 204 are coupled together. For example, as shown in FIG. 5, the arms 232 and 234 may have optional voids 233 and 235 within the material of the arms 232 and 234. The arms 232 and 234 may also have inwardly projecting ledges 250 that are configured to engage the grip members 218 of the slots 210 and 212. When the arms 232 and 234 are lowered into the slots 210 and 212, respectively, the ledges 250 may flex outwardly and form a snap or interference lit with the corresponding grip member 218. As such, the voids 233 and 235 may be used to control the flexibility of the arms 232 and 234, respectively.

When the latch member 202 is engaged with the main body 102 and the base member 204, the clamp sub-assembly 114 is held in a locked position with respect to the main body 102. The clamp sub-assembly 114 may entirely cover and have substantially the same width and height as the width $W_i$ and height $H_1$ of the back end 106. As such, the clamp sub-assembly 114 has a separate latching mechanism formed by the ledges 250 and the grip members 218 for coupling the latch and base members 202 and 204 to each other, and a separate locking mechanism formed by the fingers 236 and 238, corresponding ridges 237 and 239, and corresponding grooves 240 and 242, for securing the clamp sub-assembly 114 to the back end 106 of the main body 102.

Because the base member 204 is first inserted into the main body 102, technicians using the clamp sub-assembly 114 may organize the conductors and/or cables 181 (FIG. 1) along the base member 204 before inserting and coupling the latch member 202 to the base member 204. Organization of conductors and/or cables 181 may be substantially aided by partial engagement of base members 202 and 204 to each other. Partial engagement occurs when outer surfaces 219 of grip members 218 initially engage inner surfaces 251 of ledges 250 (i.e., before each ledge 250 flexes outwardly and forms a snap or interference fit with the corresponding grip member 218), thereby leaving a small gap between compressive grips 207 and 209. When the latch member 202 is fully coupled to the base member 204, the compressive grips 207 and 209 form an interface 206 that extends along the passage opening 144 in a side-to-side direction along the axis 193 (FIG. 2). The compressive grips 207 and 209 may be made of material (e.g., rubber) to facilitate holding the conductors and/or cables 181 along the compressive grip 207 when the clamp sub-assembly 114 is being assembled and to hold the conductors and/or cables 181 within the interface 206 when the clamp sub-assembly 114 is fully assembled without damaging or adversely affecting the conductors and/or cables 181.

The connector 100 may be configured for many applications, such as high-speed telecommunications equipment, various classes of servers, and data storage and transport devices. The connector 100 may be suitable for high speeds and maintain signal integrity while withstanding vibrations and shock that may be experienced during, for example, aerospace or military operations. However, embodiments described herein are not limited to applications for extreme environments, but may also be used in other environments, such as in an office or home.

Figure 6:
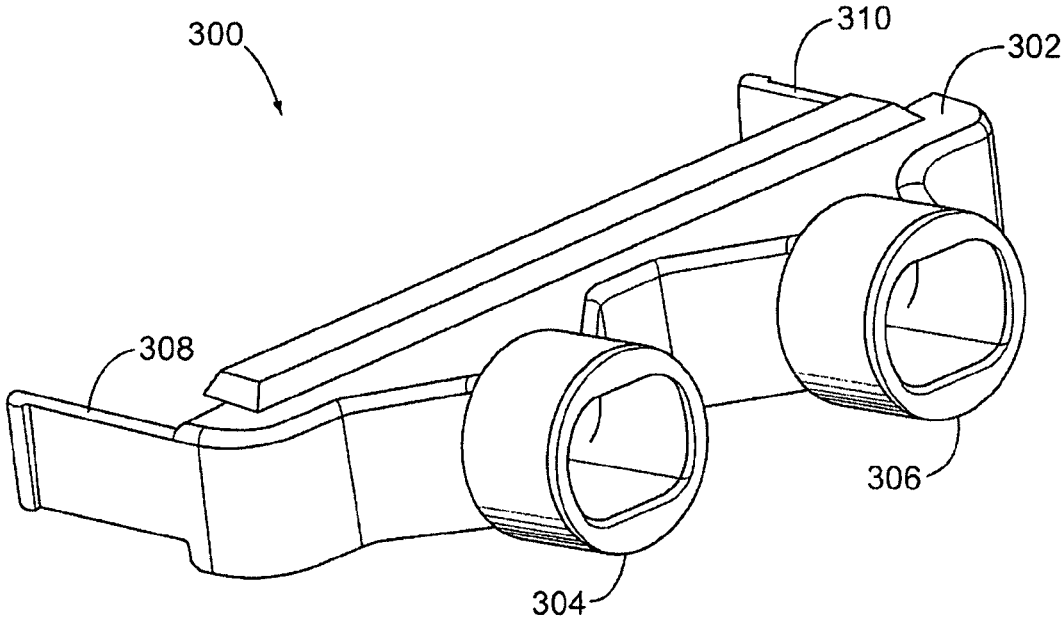
FIG. 6 is a perspective view of a component that may be used with alternative embodiments.

FIG. 6 is a perspective view of an adapter 300 that may be used with alternative embodiments of a connector (not shown) similar to the connector 100 described above. The adapter 300 may be coupled to an end of the connector body, such as the main body 102 (FIG. 2) and provide various functions such as, but not limited to, strain relief, electrical shielding, electrical grounding, and environmental protection. The adapter 300 is formed to include an adapter body 302 that incorporates flanges 304 and 306 that project rearwardly away from the adapter body 302. The inner surface of flanges 304 and 306 may couple to and hold conductors and/or cables (not shown) that extend into the connector. The outer surface of flanges 304 and 306 may couple to and hold material such as, but not limited to, common woven shield braid or grounding pigtails. There may by one or more flanges 304 and 306 that are incorporated into the adapter 300. These flanges 304 and 306 may be circular as depicted in FIG. 6 or may be formed in elliptical or rectangular cross-sections to meet typical needs. The adapter 300 may also include projections 308 and 310 that are configured to be inserted into guide channels of the connector body, such as the guide channels 120 and 122 (FIG. 2). The projections 308 and 310 may interact or engage with other features to form a locking mechanism, such as the locking mechanism described above with respect to FIG. 3.

Embodiments described herein may provide connectors having multiple components that are coupled together using fewer pieces of hardware than other known connectors. Furthermore, the connectors may provide locking mechanisms to reduce or eliminate the components of the connectors from being inadvertently disengaged. Also, the connectors described herein may provide mechanisms and methods for coupling components of the connector together. These mechanisms and methods may reduce the installation time of the connector, ease the installation or removal process, and reduce maintenance and manufacturing costs of the connector.

While the illustrated embodiment described above is designed for a specific orientation when mounted or mated with another connector, alternative embodiments may have other configurations. As such, the terms front, back (or rear), top, bottom, upper, lower, upward, downward, inward and the like are relative and based on the orientation of the illustrated embodiment, and are not intended to be restrictive. For example, in alternative embodiments, the latch member 202 may be below the base member 204. Additionally, the connector 100 may be configured to engage or receive conductors and/or cables 181 through the front end 104. Also, the passage

108 is not required to extend linearly through the main body 102, but may curve or form a right-angle in alternative embodiments.

Thus, it is to be understood that the above description is intended to be illustrative, and not restrictive. As such, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third." etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. A connector comprising:

a main body having ends and sides with a passage extending between the ends, the passage being configured to receive at least one of conductors and cables that convey at least one of signals and power, the main body including a guide channel extending from at least one end and a guide channel extending from at least one side into the main body, the guide channels joining each other at an intersection;

a first accessory having a projection that is inserted into one of the guide channels; and a second accessory having a projection that is inserted into another of the guide channels, the projections engaging each other at the intersection to secure the first and second accessories to the main body.

2. The connector in accordance with claim 1 wherein the first and second accessories constitute at least one of strain relief, electrical shielding, electrical grounding, and environmental protection.

3. The connector in accordance with claim 1 wherein the guide channels include first and second pairs, the guide channels in the first pair intersecting the corresponding guide channel in the second pair.

4. The connector in accordance with claim 1 wherein the first accessory is held in a locked position adjacent to one of the sides and the second accessory is held directly against one of the ends in a locked position.

5. The connector in accordance with claim 1 wherein the guide channels are physically separate from the passage.

6. The connector in accordance with claim 1 wherein the second accessory is directly coupled to one of the ends of the main body, the at least one of conductors and cables extending into the second accessory.

7. The connector in accordance with claim 1 wherein the guide channels are oriented substantially perpendicular to each other.

8. The connector in accordance with claim 1 wherein the main body has a side facing the first accessory and the first accessory has a side facing the main body, the main body and the first accessory being positioned adjacent to each other.

9. The connector in accordance with claim 1 wherein the connector does not use secondary fasteners for coupling the main body and the first and second accessories together.

10. The connector in accordance with claim 1 wherein one of the projections includes an aperture and the other projection has a fitted end configured to be inserted into the aperture.

* * * * *